United States Patent [19]

Salato, Jr.

[11] Patent Number: 4,858,399

[45] Date of Patent: Aug. 22, 1989

[54] PROTECTIVE COVERING AND SPACER STRIP FOR A DECK

[76] Inventor: Peter A. Salato, Jr., 236 Genesee St., Cayuga, N.Y. 13034

[21] Appl. No.: 234,514

[22] Filed: Aug. 22, 1988

[51] Int. Cl.[4] ..... E04D 13/00; E04B 1/64; E04B 1/66

[52] U.S. Cl. ..... 52/97; 52/58; 52/105; 52/410

[58] Field of Search ..... 52/105, 22, 483, 300, 52/480, 97, 58, 410; 404/37, 509; 33/526–527

[56] References Cited

U.S. PATENT DOCUMENTS

| | | | |
|---|---|---|---|
| Re, 6,401 | 4/1875 | Winslow | 52/22 |
| 325,634 | 9/1885 | Smith | 52/22 |
| 1,549,671 | 11/1925 | Kridler et al. . | |
| 2,991,857 | 7/1961 | Soderberg . | |
| 3,318,057 | 5/1967 | Norsworthy | 52/126.6 |
| 3,390,494 | 7/1968 | Chappie . | |
| 3,411,257 | 11/1968 | Yaremchuk . | |
| 3,668,828 | 6/1972 | Nicholas | 52/92 |
| 3,735,497 | 5/1973 | Boettcher . | |
| 4,080,271 | 3/1978 | Weller | 52/92 |
| 4,594,823 | 7/1986 | Hague | 52/90 |
| 4,620,403 | 11/1986 | Field . | |
| 4,742,654 | 5/1988 | Cole | 52/105 |
| 4,749,302 | 7/1988 | DeClute | 404/37 |

*Primary Examiner*—John E. Murtagh
*Attorney, Agent, or Firm*—Wall and Roehrig

[57] ABSTRACT

A channel shaped strip formed of a resilient material that is press-fitted over the beams of a deck to protect the beams from water damage and the like. The strip also contains a series of raised resilient ribs equally spaced along its length. The inside distance between adjacent ribs is equal to the width of the planking mounted upon the beams. The strips are fitted upon the beams to that the ribs are co-aligned in rows that are perpendicular to the beams so that the planks can be laid down between the ribs in spaced apart parallel alignment.

16 Claims, 1 Drawing Sheet

PROTECTIVE COVERING AND SPACER STRIP FOR A DECK

BACKGROUND OT THE DISCLOSURE

This invention relates to decking in which planks are laid down in spaced apart parallel alignment over supporting beams and in particular to a channel-shaped strip that is press-fitted over the top of each deck beam to both protect the beam from moisture and provide spacers for accurately separating adjacent planks.

Outdoor wooden decks or docks are constantly being exposed to moisture and, even with the use of pressure treated lumber, the wood will rot with continued exposure. One deck area that is most susceptible to rot is the top of the beams upon which the planking is nailed or otherwise joined. Water collects under the planks and eventually penetrates into the beam. Deck planks are typically spaced apart to leave a gap between adjacent planks so that water can more readily drain from the deck surfaces. Spacing the planks equally along the support beams, however, has heretofore proven to be a relatively time consuming and laborious task.

Field, in U.S. Pat. No. 4,620,403, discloses a method of aligning planks upon underlying joists or supporting beams in which angle irons are nailed to the top of the beams. The raised arm of each angle iron is furnished with a dependent horizontally disposed pointed tab. At assembly, each plank is driven laterally into the tabs of at least two angle irons so that one sidewall of the plank abuts the raised arms. A second set of angle irons is then set against the initially laid plank and the procedure repeated for the next plank. As can be seen, the angle irons act as spacers to align the planks along the beams and also as a means of fastening the planks to the beams. Any warpage in the planks, however, will cause the angle irons to become misaligned. This in turn, causes the planks to be angularly offset in regard to the beams. The misalignment becomes magnified as more planking is added thereby destroying the aesthetic value of the deck as well as weakening the overall strength of the deck.

Kridler et al., in U.S. Pat. No. 1,549,671, describes a gauge that is used to uniformly space furring strips upon roof rafters. The gauge includes an elongated bar having longitudinal spacers uniformly mounted along the bar. The bar is set against a rafter and the furring strips placed against the spacers and nailed in place. The gauge is then moved along the rafter to a new location. Mounting and remounting the gauge on the rafters is a time consuming procedure and because the gauge does not remain a part of the structure, it does not contribute in any way toward the soundness of the structure.

Chappin, in U.S. Pat. No. 3,390,494, describes a metal strap having a series of indentations for receiving therein building beams. In assembly, the straps are placed in perpendicular alignment over the beams. The indentations are set apart at uniform predetermined distances so that beams received in the indentations are located at centers dictated by local building codes. The straps are nailed directly to the beams and function in assembly to retain the beams in their desired locations and add lateral strength to the building frame.

SUMMARY OF THE INVENTION

It is therefore an object of the present invention to enhance the quality of decks and the like in which planks are equally spaced upon supporting beams to provide a gap between adjacent planks.

It is a further object of the present invention to protect the support beams used in decks while at the same time providing a rapid method of uniformly spacing deck planking upon the beams.

Another object of the present invention is to simplify the construction of wooden decks, docks, foot bridges, or the like wherein planks are uniformly spaced upon perpendicularly aligned support beams.

Yet another object of the present invention is to provide protective spacer strips for decks that can accommodate warped or irregular shaped planks without destroying the overall integrity of the deck planking.

These and other objects of the present invention are attained by means of a protective cover and spacer strip that can be placed over the wooden rectangular shaped beams of a deck. The strip is a channel-shaped member which is formed from a resilient material that is readily pierced by a nail, tack, staple or the like. The inside width of the channel is substantially equal to the width of the beam so that the channel can be press fitted over the top of the beam to provide a protective cover. The channel also contains a series of raised resilient ribs equally spaced along its top surface with the inside distance between adjacent ribs being equal to the width of the deck planking. The planks are laid between aligned rows of ribs and are joined to the beams by nailing directly through the strips.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Turning now to the drawings, there is shown a section of a deck, generally referenced 10, that utilizes the present invention to both protect the underlying support beams and to uniformly space the overlying planks that are mounted upon the plank. The term deck is herein used in the broad sense to identify any type of predominantly outdoor platform having a plank flooring wherein a gap is provided between adjacent planks to permit water to readily drain from the top surface thereof. The deck includes parallel spaced apart wooden beams 12—12 constructed from standard size timbers which are set on edge so that the depth or height of each beam is greater than its width. Planks 15—15 of any suitable length are mounted upon the beams with the planks being perpendicularly disposed with regard to the beams. A gap 17 is provided between adjacent planks. The gap is narrow enough so that it does not pose a danger to one walking upon the deck, but sufficiently wide so that water will readily drain from the top of the deck. In practice, the planking is also constructed from standard size pieces of lumber that are laid face down so that the width of each plank is greater than its height.

Figure 1:
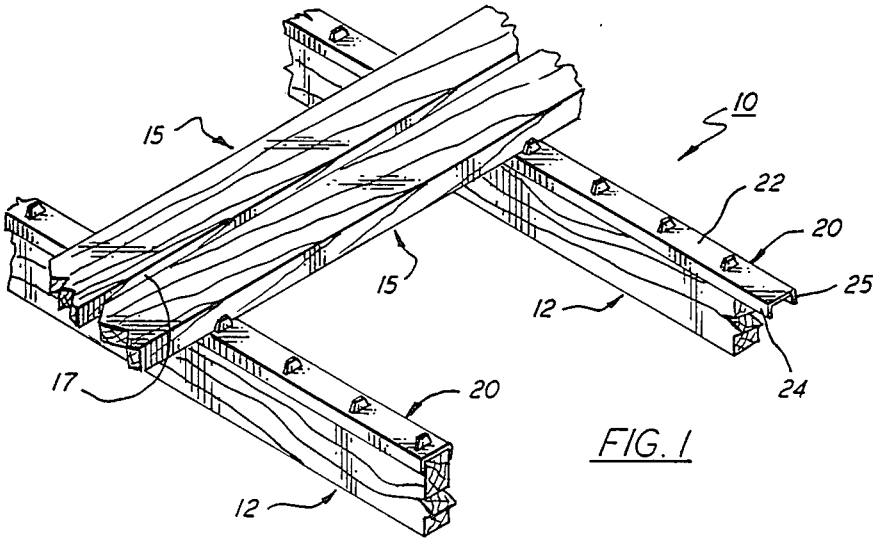
FIG. 1 is a partial perspective view of a deck utilizing the present invention.

Channel shaped strips 20—20 are mounted upon the top of each beam as illustrated in FIG. 1. Each strip contains a top wall 22 and a pair of opposed side walls 24 and 25 that depend from the top wall. The inside width of channel between the opposing side walls is equal to the width of the beams. The strips are formed from a resilient material so that they can be press-fitted over the top of each beam to bring the top wall of the channel in contact with the top surface 27 (FIG. 2) of the beam. The side walls of the channel extend downwardly a short distance over the sides of the beam so that the entire top portion of the beam is protectively shielded by the strip. Any moisture that might collect upon the strip will be conducted downwardly along the channel side walls and allowed to drop down below the beam. Accordingly, collected moisture is afforded little or no contact with the beam, thereby preventing corrosion and extending the useful life of the beam.

The depth of each channel side wall is about equal to or slightly less than the width of its top wall. This provides sufficient contact area for strips so that it will remain well seated upon the beam when press-fitted thereon. Although the lower portion of the beam remains uncovered, the channel will prevent moisture from collecting in critical beam areas and thus provide adequate protection for the beams even under adverse conditions.

A series of elongated raised ribs 30—30 are uniformly spaced along the top 22 of the channel. Each rib is generally rectangular in form with the axis of the rib being perpendicular to the channel side walls. The inside distance between adjacent ribs is equal to the width of the planks mounted upon the beams. Accordingly, the planks can be tightly fitted between the ribs to both locate and align the planks in assembly. The strips are mounted on the beams so that the ribs on the strips are co-aligned in parallel rows with the rows being perpendicular with regard to the longitudinal axis of the beam. As can be seen, the planks seated between adjacent ribs are automatically positioned at the time of assembly so that the planks are perpendicularly aligned on the beams and spaced apart by a uniform gap. Accordingly, the assembled deck is not only structurally strong but also aesthetically pleasing. In addition to providing protection, the strips enable the deck to be quickly erected by using relatively unskilled labor.

Figure 2:
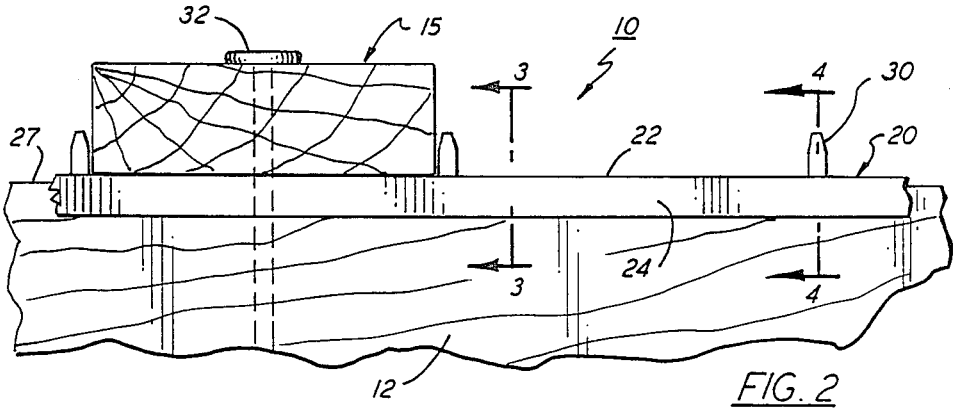
FIG. 2 is a partial enlarged side elevation of the deck shown in FIG. 1.
Figure 3:
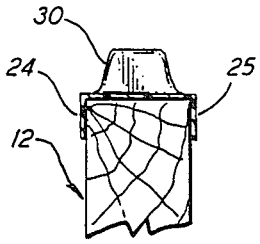
FIG. 3 is a sectional view taken along lines 3—3 in FIG. 2.
Figure 4:
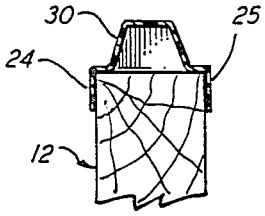
FIG. 4 is also a sectional view taken along lines 4—4 in FIG. 2.

Preferably, as shown in FIG. 4, each rib is a hollow, thin-walled member that can be slightly deformed when pressure is applied thereto. Accordingly, the ribs will automatically deform to accommodate warped or irregular shaped planks without upsetting the overall alignment of the remaining planks. The strip preferably is formed of a plastic material that is easily penetrated by a nail or the like without the strip splitting or cracking. As shown in FIG. 2, once a plank is mounted upon a strip, between the ribs, it can be secured to an underlying beam by simply driving a nail 32 through both the plank and the strip into the beam.

The channel member is preferably formed using a thermal vacuum forming technique whereby flat sheets of polystyrene, vinyl, or the like are molded to the final configuration shown. Other suitable forming techniques and materials, however, can also be used without departing from the teachings of the present invention. The material used to form the strip should not only be resilient enough so that the side walls of the channel will deform sufficiently to permit the channel to be press-fitted onto the beam, but also to allow the hollow rib to deform sufficiently to accommodate warped beams between the ribs. It has been found that strips vacuum formed from 0.060 inch thick strips of polystyrene are well suited for this purpose. In addition, the thin strips can be easily cut into desired lengths using conventional shears or scissors.

While this invention has been explained with reference to the structure as disclosed herein, it is not confined to the details set forth and this application is intended to cover any modifications and changes as may come within the scope of the following claims.

What is claimed is:

1. A combination protective cover and spacer strip for mounting upon a wooden rectangular beam which supports horizontal planks that include a channel molded of a resilient material, said channel having a top wall and a pair of dependent opposed side walls, the inside width of said channel between the sidewalls being equal to the width of a beam to permit the strip to be press-fitted over the top of the beam, a series of resilient deformable ribs projecting from and equally spaced along the top wall of said channel, said ribs being transversely aligned with the side wall edges of the channel with the longitudinal distance between adjacent ribs being equal to the width of planks supported upon said beam whereby said planks seated between said ribs are equally spaced to provide a uniform gap between adjacent planks.

2. The strip of claim 1 whereby the depth of said opposed side walls of the channel is less than one-half the width of the top wall of the channel.

3. The strip of claim 1 wherein the channel is molded from a plastic that is easily penetrated by a nail without splitting or cracking whereby the planks can be nailed to the beam through said strip.

4. The strip of claim 3 wherein said ribs are hollow members having a height that is less than the depth of the planks mounted therebetween, said ribs having a resiliency such that the ribs can deform to accommodate warped or irregular shaped planks mounted between the ribs.

5. The strip of claim 1 wherein the ribs are solid members having a height that is less than the depth of the planks mounted therebetween.

6. The strip of claim 4 wherein the channel is vacuum formed from elongated strips of polystyrene.

7. The strip of claim 6 wherein the wall thickness of the channel and the hollow ribs is about 0.060 inches.

8. A deck that includes spaced apart parallel beams and planks mounted transversely across the beams, each beam having a channel formed of a resilient material, said channel being press-fitted over the top of a beam with the top wall of the channel abutting the top of said beam and the opposing side walls of the channel extending downwardly to partially cover the sides of said beam, each channel having deformable ribs projecting from the top wall thereof that are equally spaced along the length of the channel so that the longitudinal distance between the inside of each pair of adjacent ribs is equal to the width of said planks, said ribs being aligned in parallel rows with said rows being transverse to said beams, and said planks being mounted upon the beams between said ribs whereby the planks are equally spaced along the length of the beams.

9. The deck of claim 8 wherein the channel ribs are hollow members that deform when warped or irregular shaped planks are mounted therebetween.

10. The deck of claim 9 wherein the channels are formed of a polystyrene.

11. The deck of claim 8 wherein the height of each rib is less than the width of the planks.

12. A combination protective cover and spacer strip for mounting upon a wooden rectangular beam which transversely supports horizontal planks, said protective cover and spacer strip including a channel molded of a resilient material, said channel having a top wall and pair of dependent opposed side walls, the inside width of said channel between the sidewalls being about equal to the width of a beam to permit the strip to be press-fitted over the top of the beam, a series of resilient deformable; ribs projecting from and equally spaced along the top wall of said channel, said ribs being spaced apart so that the distance between adjacent ribs is about equal to the width of planks transversely supported upon said beam.

13. The strip of claim 12 wherein the channel is molded from a plastic that is easily penetrated by a nail without splitting or cracking whereby the planks can be nailed to the beam through said strip.

14. The strip of claim 12 wherein said ribs are hollow members having a height that is less than the depth of the planks mounted therebetween, said ribs having a resiliency such that the ribs can deform to accommodate warped or irregular shaped planks mounted between the ribs.

15. The strip of claim 12 wherein the channel is vacuum formed from an elongated strip of polystyrene.

16. The strip of claim 15 wherein the wall thickness of the strip is about 0.060 inches.

* * * * *